United States Patent [19]

Rhoton et al.

[11] Patent Number: 4,571,762

[45] Date of Patent: Feb. 25, 1986

[54] HYBRID WATERBED CAVITY

[75] Inventors: Albert L. Rhoton, Cypress; Gregory A. Ribblett, Hacienda Heights, both of Calif.

[73] Assignee: Morgan Flotation Systems, Los Angeles, Calif.

[21] Appl. No.: 633,935

[22] Filed: Jul. 24, 1984

[51] Int. Cl.[4] ..... A47C 27/08

[52] U.S. Cl. ..... 5/451; 5/474

[58] Field of Search ..... 5/451, 452, 450, 455, 5/481, 449, 422, 474

[56] References Cited

U.S. PATENT DOCUMENTS

| | | | |
|---|---|---|---|
| 4,187,566 | 2/1980 | Peterson | 5/451 |
| 4,189,798 | 2/1980 | Vessey | 5/451 |
| 4,245,364 | 1/1981 | Calleance | 5/452 |
| 4,349,926 | 9/1982 | Winther | 5/452 |
| 4,352,217 | 10/1982 | O'Rourke | 5/451 |

*Primary Examiner*—Alexander Grosz

*Attorney, Agent, or Firm*—Blakely, Sokoloff, Taylor & Zafman

[57] ABSTRACT

The present invention is a cavity for hybrid waterbeds. The side walls of the cavity are of resilient grade foam and are broader at the top plane than at the bottom plane. The hybrid waterbed cavity of the present invention retains the positive qualities found in conventional waterbed cavities of holding and retaining a waterbed mattress, and eliminates the undesirable qualities of the reduction of sleeping surface area and the creation of excess stress on the surrounding cover which occurs when conventional cavities are subjected to body weight.

15 Claims, 9 Drawing Figures

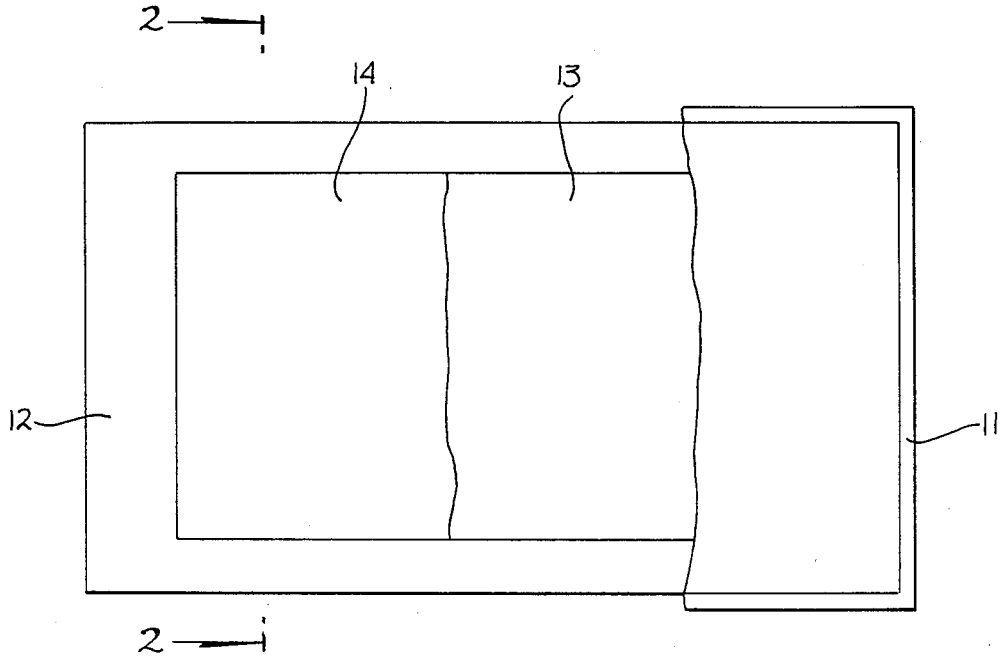
Fig. 1
Fig. 2
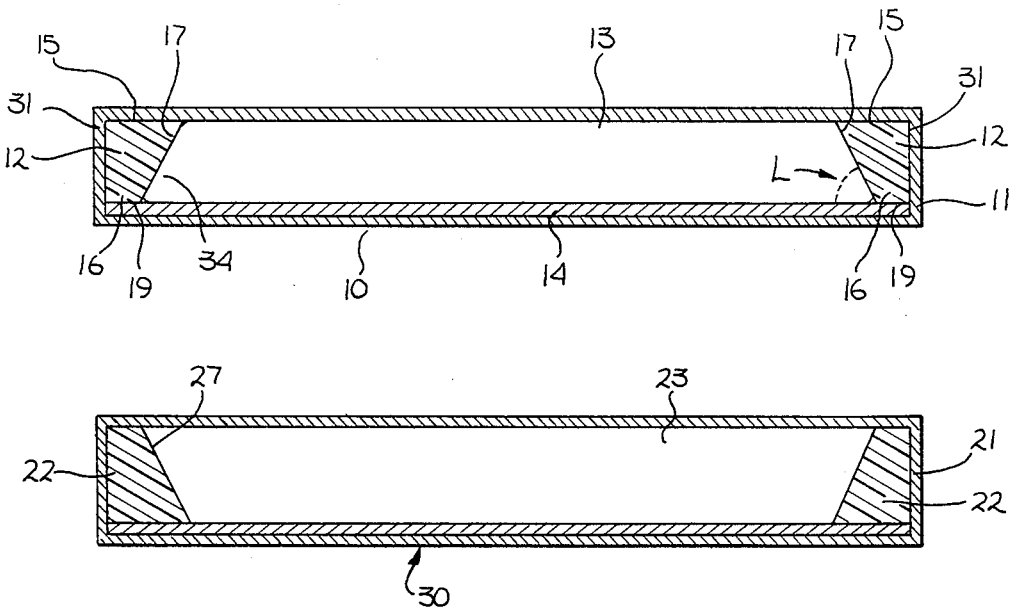
Fig. 3 (Prior Art)

HYBRID WATERBED CAVITY

FIELD OF THE INVENTION

This invention relates to waterbeds, and more particularly, to a frame for a hybrid waterbed system.

BACKGROUND

Since the late 1960's, when waterbeds were first introduced, waterbeds have been gaining increasing acceptance. It has been recognized that waterbeds provide dimensions of comfort and bodily support not available from conventional inner spring or foam mattress bedding systems. Waterbeds have also become favored for therapeutic and other user qualities.

The structural design of waterbeds has evolved since their introduction. Waterbed mattresses were initially utilized without outside supports, or else, were disposed in simple wooden frames. It has always been preferable to support the sides of the mattress in a frame to provide support to the mattress itself, thereby preventing excessive strain on the mattress material. However, wooden side rails comprising the early frame designs are hard, and therefore, are uncomfortable to users who bump, lie or sit on them when getting out of, or into, the waterbed. Other prior art waterbed frames comprised hard foam side rails in place of the wooden side rails, the foam side rails being integrally packaged with the mattress into a single unit.

Another variation of frame design is disclosed in U.S. Pat. No. 4,197,602 issued to Johenning in which the frame is formed of foam pads with a pocket therein along the long access thereof, said pocket containing hard wooden support slats disposed therethrough. This design is comfortable to a user and provides reasonable support to the sides of the mattress. However, this frame is rather cumbersome to manufacture in that the side rail pads have to be formed with pockets to hold the slats, and the slats must be installed in said pockets.

Another drawback of early waterbed designs is that they were succeptiable to excessive wave motion in the waterbed mattress, which can make users of the waterbed uncomfortable. A number of solutions to the problem of excess wave motion have been developed, including the hybrid waterbed. In a hybrid waterbed, the frame thereof, generally referred to as a cavity, comprises four side walls of firm urethane foam adhered to a base comprising a sheet of soft urethane foam. The side walls have a cross section in the shape of a right trapezoid, the right angle thereof being defined by the outside face and bottom plane of the side wall, and the inside plane facing the mattress having an angle of approximately 350° to the horizontal. The typical dimensions of a side rail include the top plane being three inches, and the bottom plane being six inches, with the height of the side rail also being six inches. A fabricated cover surrounds the entire frame and the waterbed mattress, the entire assembly generally being a finished, integral piece.

Due to the trapezoidal configuration of the side wall with the base surface being wider than the top surface, any pressure on the top surface, such as when the user sits or lies thereon, tends to cause the side wall to bend outward. This results in excess stress on the bond between the side wall and the base, as well as excess stress on the surrounding cover.

In order to minimize this distortion, the foam used in the fabrication of the side walls is a firm grade foam.

The firmness of polyurethane and other foams 25 is graded by the foam industry on a scale known as the indent load deflection scale (hereinafter referred to as "ILD"). On this scale, the lower numbers indicate that the foam is very liable, whereas higher numbers of about 100 above, indicate the foam is stiff.

The side walls of a hybrid waterbed frame are normally produced using a foam with an ILD of about 100. Due to the firmness of the side walls, they do not yield to the same degree as a waterbed mattress, and are therefore more like the wooden side rails discussed above. Thus, these side rails are relatively uncomfortable and cannot be used by typical waterbed users as part of the normal sleeping surface.

SUMMARY OF THE INVENTION

The present invention is a hybrid cavity with the side walls formed of soft foam material, said side walls having a cross section comprising a right trapezoid with the top plane thereof havin a greater width than the bottom plane and the inside plane forming an acute angle with the horizontal, angling downward and outward from top to bottom of the side wall. The side walls are adhered to a base comprising a soft foam sheet by means of an adhesive material. The entire waterbed cavity assembly and mattress are surrounded by fabricated cover, as in the prior art devices.

The invented hybrid waterbed cavity is capable of holding and retaining a hybrid waterbed mattress in the same manner as that disclosed in the prior art. In addition, the invented cavity eliminates the problem of outward deflection of the side walls as a result of the pressure upon the upper surface of the side walls so that soft foam can be used in the manufacture of the side walls in place of hard foam. Thus, entire surface of the invented hybrid waterbed mattress and side walls may be used as a comfortable sleeping surface. In another embodiment of the present invention the side walls have a cross section which does not make a right triangle, but which still has a top plane having a greater width than the bottom plane.

BRIEF DESCRIPTION OF THE DRAWINGS

FIG. 1 is a cutaway, top view of an embodiment of the present invention.

FIG. 2 is a side sectional view of the present invention taken along 2—2 of FIG. 1.

FIG. 3 is a side sectional view of the prior art hybrid waterbed cavity.

DETAILED DESCRIPTION OF THE DRAWINGS

Figure 4:
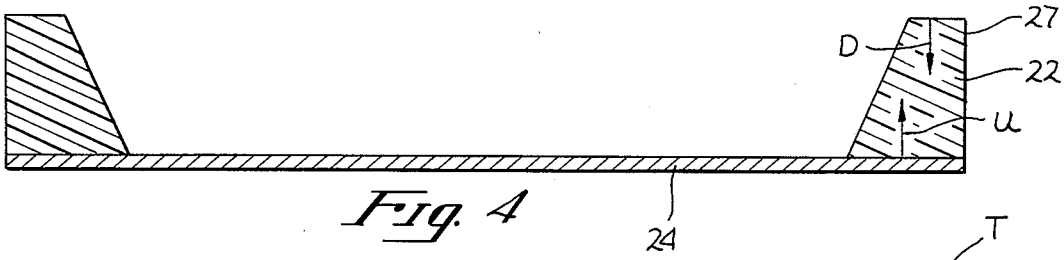
FIG. 4 illustrates a force diagram of the prior art cavity.

The present invention is a novel hybrid waterbed cavity 10 having four side walls 12 with the top plane 15 being wider than the bottom plane 16. The bottom plane 16 is adhered to a soft foam base sheet 14 by conventional adhesives commonly used in the art. A mattress 13 is disposed within the cavity 10, the mattress in use, being filled with water. A fabricated cover 11 surrounds the entire assembly.

In the preferred embodiment, the side wall 12 is in the shape of a right trapezoid, with the inside plane adjacent the waterbed mattress and being angled downward and outward. Preferably the inside plane forms an angle L with the horizontal of about 135°. The top plane 15 of the side wall 12 is preferably in a size ratio with the bottom plane 16 of two to one (2:1), although any size ratio greater than one to one (1:1) would be effective.

With the side wall configured as described, the need for making the side wall of hard foam material is obviated, due to the fact that the side wall will not deflect outward when force is exerted downward thereon. Thus while prior art foam used for side walls typically has an ILD of about 100, the side walls of the present invention can utilize foam in the range of 18 to 100 or greater, and preferably about 25 to 65. A polyurethane foam with an ILD of 45 has proven to be particularly comfortable to users. This foam is much less firm, and therefore much more comfortable to a user, than the foam preferably used in the prior art, and in fact, the deflection of this foam approximates the deflection of the waterbed mattress. Thus, the user of the invented waterbed can utilize the entire surface of the bed, including the side rails, and therefore has a large surface area on which to comfortably sleep. Moreover, since the foam deflects to approximately the same degree as the mattress, there are no substantial gaps between the mattress and the sidewalls resulting from downward pressure exerted at the junction 19 therebetween. Conversely, in the prior art hybrid waterbeds 30, as shown in FIG. 3, the pressure at the junction 27 would result in the mattress being depressed while the relatively stiff side wall remains intact, thus causing a gap between the side wall 22 and mattress 23.

The present invention not only retains the desirable qualities of conventional cavities of holding and retaining the waterbed mattress, it eliminates the unwanted outward distortion and accompanying bond and cover stress resulting when the side wall of conventional cavities is subjected to body weight. The side wall of the present invention, under body weight, deflects inward and downward, putting no stress on the outside cover. In addition, the present invention results in a hybrid waterbed with a sleeping surface with an effective area bounded by the outer perimeter of the waterbed cavity.

Figure 5:
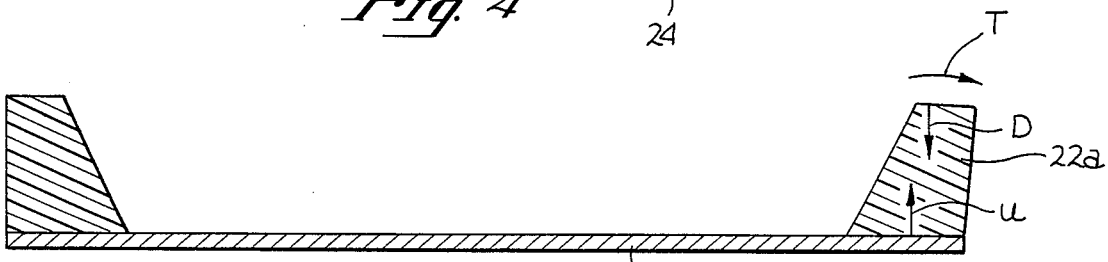
FIG. 5 illustrates a force diagram of the prior art cavity with greater force exerted in the downward direction than in FIG. 4.
Figure 6:
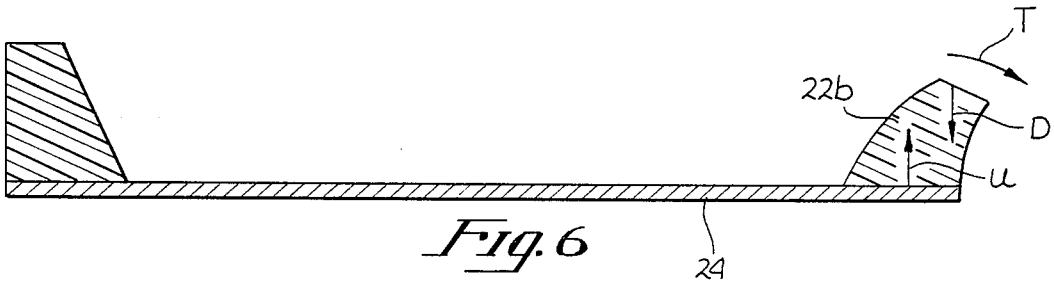
FIG. 6 illustrates a force diagram of the prior art cavity showing the outward deflection of the side wall under greater force than in FIG. 5.
Figure 7:
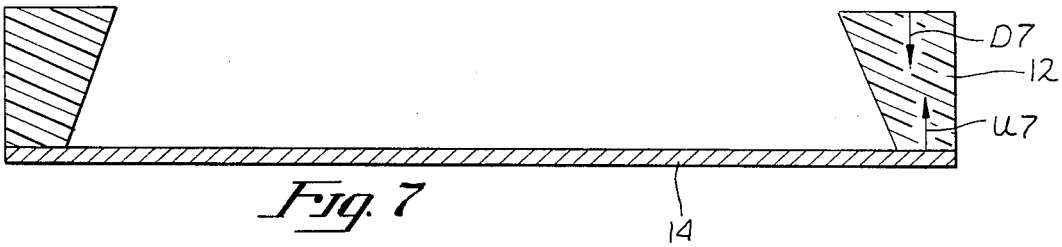
FIG. 7 illustrates a force diagram of the invented cavity.
Figure 8:
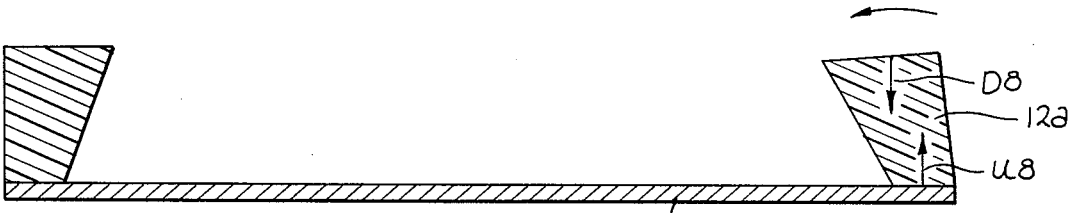
FIG. 8 illustrates a force diagram of the invented cavity with greater force exerted in a downward direction than in FIG. 7.
Figure 9:
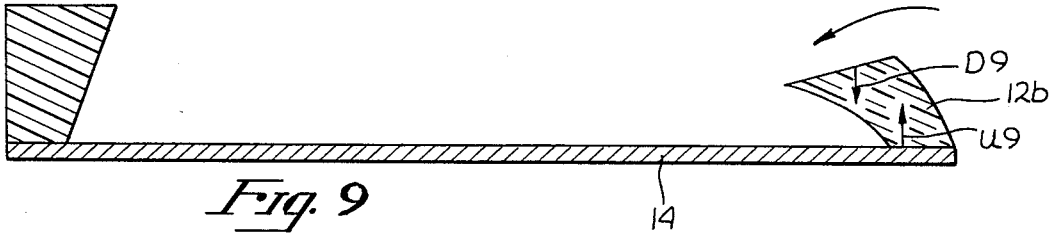
FIG. 9 illustrates a force diagram of the invented cavity showing the inward deflection of the side wall under greater force than in FIG. 8.

Without being bound by any theory, the applicants believe that the force diagrams set forth in FIGS. 4–9 illustrate the operation of the present invention in relation to the prior art. FIGS. 4–6 illustrate the prior art cavity, assuming the side wall to be made with non-rigid foam having a relatively low ILD, such as about 45, and FIGS. 7–9 illustrate the invented cavity.

Referring first to FIG. 4, it is assumed that the net upward and downward forces on the side wall are equal, since the side wall is not in motion. It is further assumed that the forces are directed through the center of their respective surfaces. Thus, in FIG. 4 the downward force D4 is equal in magnitude, but displaced closer to the vertical edge 29 than upward force U4.

When a user of the waterbed sits on the side wall downward or force is otherwise applied, a greater force D5 is applied downward causing the foam to compress mostly at the outer edge, and creating a torque on the side wall which causes the sidewall to deflect outward to position **22*a*. Generally, this outward deflection would cause a user to shift his weight further inward toward the center of the waterbed, to avoid sliding off the tilting side wall 22*a*, which in turn adds additional outward torque so that the side wall deflects outward even further. This deflection, in turn, creates excessive torque on the junction between side wall 22*a* and base 24**.

As shown in FIG. 6, the greater the downward force D6 is, the more the side wall **22*b* deflects outward. U6 represents the upward force. Of course, since the cavity 30 is surrounded by a fabric covering 21, as shown in FIG. 3**, the outward deflection is limited thereby, although excess stress is placed on the cover thereby decreasing its life.

On the other hand, relying on the same assumptions as previously expressed, in the invented cavity, as illustrated in FIG. 7, downward force D7 through the center of the top surface 15 is located further inward than the upward force U7. Therefore, as shown in FIG. 8, when a user sits on the side wall **12*a*, the torque provided by the added weight acting through the center of the respective top 15 and bottom 16 surfaces, caused the side wall 12*a* to bend inward. Moreover, as shown in FIG. 9, the greater the downward force D9 is, the greater the tendency for the side wall 12*b* to bend inward is, so that the foam compresses more along the incline plane 17 than along the outer edge 31**.

Of course, as shown in FIG. 2 the incline plane is disposed over the outer most edge 34 of the mattress, which acts to support the side wall 12 so that the amount of bending thereof is minimized, and minimum torque is placed on the joint between the side wall 12 and base sheet 14.

The present invention has been described in terms of its preferred embodiments. However, one skilled in the art can readily ascertain that the present invention can be easily modified to appear in substantially equivalent embodiments. For example, the inside plane 17 of side wall 12 need not to be a straight line. The desirable attributes of the present invention are retained when the plane 17 is curved, waved, ore stepped.

I claim:

1. An improved hybrid waterbed mattress comprising four side walls formed of foam material, a base formed of soft foam material and having a top and bottom surface, the bottom surface of said side walls adhering to the base thereby supporting said sidewalls in a vertical position, a bladder for retaining water surrounded by said side walls and diposed on said base, and a cover material surrounding said mattress, side walls and base, the improvement comprising side walls having a top surface and bottom surface, said top surface being of greater width than said bottom surface, and an inclined plane surface disposed over the edge of said bladder, whereby outward deflection of the side wall under downward pressure is minimized.

2. The improved mattress of claim 1 wherein the cross-section of said side rail is formed as a right trapezoid.

3. The improved mattress of claim 2 wherein said side rail is formed of resilient foam, whereby the effective comfortable surface area of a hybrid waterbed mattress comprising the improved cavity includes the side walls.

4. The improved mattress of claim 3 wherein said side rail is formed of foam having a deflective modulus which approximates the deflective modulus of the bladder.

5. The improved mattress of claim 1 wherein the shape of a vertical cross-section of the side wall is a right trapezoid, the trapezoid having a width at the top plane equal to about 2 times the width of the bottom plane, and the trapezoid having a height approximately equal to the length of the top plane.

6. The improved mattress of claim 1 wherein the foam has an ILD number between 18 and 100.

7. The improved mattress of claim 6 wherein the foam has an ILD of about 25 to 65.

8. The mattress of claim 1 wherein the soft foam is chiefly polyurethane foam.

9. A a hybrid waterbed mattress comprising:

a base of resilient foam;

a plurality of side walls, said side walls having a top surface and a bottom surface, said bottom surfaces of said side walls adhering to said base so that said side walls are vertically disposed, said top surface being wider than said bottom surface and extending over a portion of a water containing bladder installed in said cavity, whereby outward deflection of the side wall under downward pressure is minimized and stress is the bond between the side wall and base is reduced.

10. The mattress of claim 9 wherein said side walls have vertical cross-section in the shape of a right trapezoid such that the inclined plane surface of said trapezoid is adjacent a water containing bladder installed in said cavity.

11. The mattress of claim 9 wherein said foam is resilient, whereby a comfortable sleeping surface comprising said bladder and said side walls is formed.

12. A hybrid waterbed mattress comprising:

four side walls having a vertical cross-section in the shape of a right trapezoid, the inclined plane of said trapezoidal side wall disposed adjacent and above an outer edge of a water containing bladder disposed in said cavity, said side walls being formed of resilient foam, and a base comprising a sheet of resilient foam, said side walls adhering to said base by means of adhesive therebetween, whereby outward deflection of sidewalls under downward pressure is minimized and an enlarged comfortable sleeping surface is formed by the bladder disposed in said cavity and said side walls.

13. The mattress of claim 12 wherein said foam is polyurethane.

14. The polyurethane foam of claim 13 having an ILD of less than 100.

15. The polyurethane foam of claim 14 having an ILD of about 25 to 65.

* * * * *